US010504494B2

(12) United States Patent
Reiser

(10) Patent No.: US 10,504,494 B2
(45) Date of Patent: Dec. 10, 2019

(54) B/F TENOR TROMBONE FOR CHILDREN

(71) Applicant: Thomann GmbH, Burgebrach (DE)

(72) Inventor: Wolfgang Reiser, Tutschengereuth (DE)

(73) Assignee: Thomann GmbH, Burgebrach (DE)

( * ) Notice: Subject to any disclaimer, the term of this patent is extended or adjusted under 35 U.S.C. 154(b) by 0 days.

(21) Appl. No.: 15/995,064

(22) Filed: May 31, 2018

(65) Prior Publication Data

US 2018/0350329 A1 Dec. 6, 2018

(30) Foreign Application Priority Data

May 31, 2017 (DE) ..... 20 2017 103 260 U

(51) Int. Cl.
*G10D 7/04* (2006.01)
*G10D 7/10* (2006.01)
*G10D 9/04* (2006.01)

(52) U.S. Cl.
CPC ..... *G10D 7/10* (2013.01); *G10D 9/04* (2013.01)

(58) Field of Classification Search
CPC ..... G10D 7/10
See application file for complete search history.

(56) References Cited

U.S. PATENT DOCUMENTS 468,116 A * 2/1892 Robinson ..... G10D 7/10 84/395
530,781 A * 12/1894 Leland ..... G10D 7/10 84/396
932,704 A * 8/1909 Holton ..... G10D 7/10 84/395
2,027,340 A * 1/1936 Holton ..... G10D 7/10 84/395
2,093,993 A * 9/1937 Adriani ..... G10D 7/10 84/395
2,669,152 A * 2/1954 Shuman ..... G10D 7/10 84/395
3,903,779 A * 9/1975 McCracken ..... G10D 9/04 84/395
3,937,116 A * 2/1976 Ramirez ..... G10D 7/10 84/395
4,831,911 A * 5/1989 Wanner ..... G10D 7/10 84/395
4,996,902 A * 3/1991 Hulot ..... G10D 7/10 84/390
5,365,823 A * 11/1994 Leonard ..... G10D 7/10 84/394
5,375,499 A * 12/1994 Leonard ..... G10D 7/10 84/395

(Continued)

*Primary Examiner* — Robert W Horn
(74) *Attorney, Agent, or Firm* — Mark Terry

(57) ABSTRACT

B/F tenor trombone for children, comprising a sound part and a slide, composed of an inner slide and an outer slide being movably disposed thereon, wherein the total length formed by sound part and slide has a tubing length $L_{s1}+L_{s2}+L_{s3}+L_{z1}+L_{z2}+L_{z3}$, and wherein in the 1st register, the slide has a tubing length $L_{z1}+L_{z2}+L_{z3}$ of less than 150 cm, and wherein the sound part has a tubing length $L_{s1}+L_{s2}+L_{s3}$ of more than 125 cm.

7 Claims, 1 Drawing Sheet

(56) References Cited

U.S. PATENT DOCUMENTS

| | | | | | |
|---|---|---|---|---|---|
| 5,435,222 | A * | 7/1995 | Leonard | G10D 7/10 | 84/388 |
| 5,834,666 | A * | 11/1998 | Wanner | G10D 7/10 | 84/395 |
| 7,608,767 | B1 * | 10/2009 | Barth | G10D 9/026 | 84/383 R |
| 8,247,675 | B2 * | 8/2012 | Griego | G10D 9/005 | 84/387 R |
| 2018/0350329 | A1 * | 12/2018 | Reiser | G10D 9/04 | |

* cited by examiner

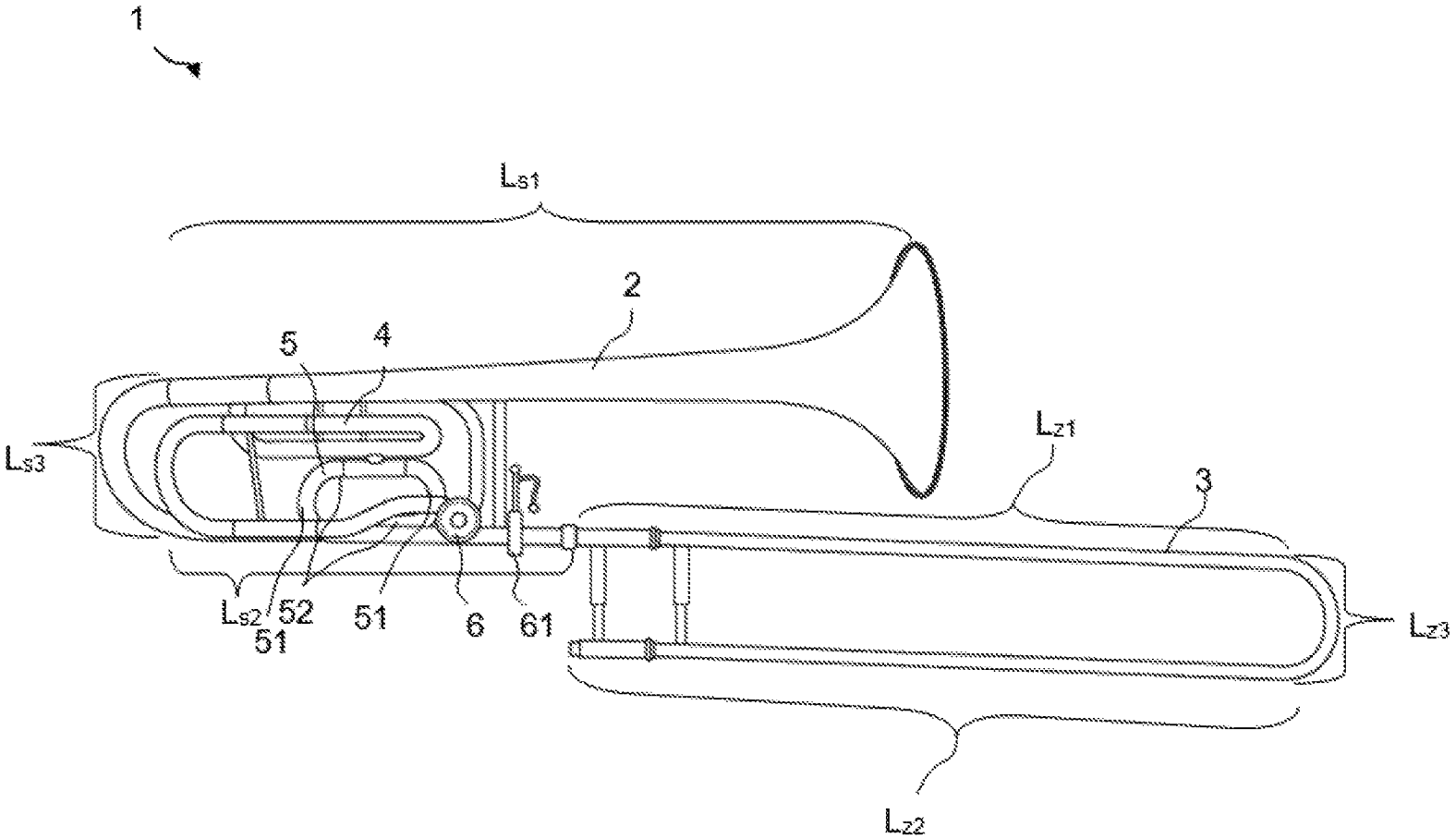
1
2
3
4
5
6
51
52
51
61
$L_{s1}$
$L_{s2}$
$L_{s3}$
$L_{z1}$
$L_{z2}$
$L_{z3}$

B/F TENOR TROMBONE FOR CHILDREN

CROSS-REFERENCE TO RELATED APPLICATIONS

This patent application claims priority to German utility patent application number 20 2017 103 260.4 filed May 31, 2017 titled "B/F Tenor Trombone For Children". The subject matter of patent application number 20 2017 103 260.4 is hereby incorporated by reference in its entirety.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

BACKGROUND

Tenor trombone hereinafter refers to a slide trombone, in which a so-called slide (hand slide) extends the length of the air column by being slid outward for the purpose of pitch change, whereby a low-pitched tone is generated. The slide is composed of an inner slide and an outer slide. The inner slide has two ducts which are interconnected via a brace, wherein a mouthpiece is placed onto one of the ducts. The outer slide, which is composed of two ducts being interconnected via a semi-circular tube bend in a U-shaped manner, is slid onto the inner slide. In order to play the instrument, the outer slide is slid back and forth on the inner slide.

Tenor trombones are most commonly pitched in B. As with every other brass wind instrument, a B/F tenor trombone has a "natural tone series" which can be blown by the trombonist by alteration of the lips (tension), tongue and breathing, with the slide being closed (e.g. in the 1st register). Said "natural tone series" for the B/F tenor trombone is as follows:

| | | |
|---|---|---|
| 1. | natural tone | B (contra B) |
| 2. | natural tone | B |
| 3. | natural tone | F (note f) |
| 4. | natural tone | B (note b) |
| 5. | natural tone | D (note d`) |
| 6. | natural tone | F (note f`) |
| 7. | natural tone | As (soundless) |
| 8. | natural tone | B (note b') |

The basic length $L_0$ of the trombone is difficult to measure. The total tubing length can have a minimal variation despite having the same basic tuning with varying bore size and tube diameter. The tubing lengths are taken with the aid of a cord in the middle of the straight tubes and bends. Moreover, the actual lengths are shorter than the calculated lengths, since in practice, extension of the instrument is possible only to a limited degree by sliding of the main tuning slide, in order to "tune" itself with respect to other instruments. The basic length $L_0$ of the trombone, however, can be calculated for B tuning as follows. $L_0$=(number of natural tone+1)$\lambda_B/2$. A 20° C. speed of sound of c=34500 cm/s and the frequency for the 7th natural tone B ($f_b$=466.2 Hz) results in the wavelength $\lambda_B$ of 74 cm. The basic length $L_0$=8/2×74 cm thus corresponds to 296 cm.

By means of the slide, the tubing length can be altered beyond the basic length $L_0$ of the trombone. In order to play chromatically between the individual natural tones, the instrument is accordingly extended via the slide. In principle, the slide position can be calculated due to the above formula for all tones in accordance with a tubing length assigned to the frequency as a difference to the basic length $L_0$. Hereinafter, slide position and register are used analogously. The tubing length for the g ($f_g$=196 Hz; 3th natural tone) results in 352 cm, so that the difference (352 cm−296 cm)/2 corresponds to a slide position of 28 cm (starting from a slide position for the first register). The division by 2 is a result of the two legs of the slide. When looking beyond contra B (1st natural tone) in this natural tone series, the largest interval arises from the 2nd natural tone to the 3rd natural tone. In order to be able to play this fifth (B-f) in semitone steps, as a rule, seven slide positions (registers) are distinguished, between which the slide can be slid continuously. The registers in each case differ by one semitone

| slide position | upgrade to semitones |
|---|---|
| I. | 0 (natural tone) |
| II. | 1 |
| III. | 2 |
| IV. | 3 |
| V. | 4 |
| VI. | 5 |
| VII. | 6 |

B/F tenor trombones are available with a quart valve. The quart valve is a rotary valve (cylinder valve) having a valve body which can be rotated by 90° and which is passed through by two tubular channels. Upon activation of the rotary valve, the valve body rotates and redirects the air flow in such a manner that a valve slide is activated, whereby the length of the air column is extended, and the tone becomes lower in pitch. The valve slide has precisely the length which lowers the fundamental tone of the instrument by one fourth (from B to F) when the valve is pressed down.

The largest tone jump of one octave (12 semitones) lies between the 1st and the 2nd natural tone. With the aid of the quart valve, all chromatic tones lying therebetween can be played, which is not possible in the absence of a quart valve. Upon activation of the quart valve, the instrument is basically upgraded by 5 semitones. All slide positions are somewhat more remote from one another due to the larger length when the valve is being pressed down, so that normally only 6 slide positions can be played. The activated valve slide of the quart valve also has its own tuning slide. With the aid of the quart valve, the slide positions alter as shown in the following example with the F tuning.

| slide position | slide position with quart valve | |
|---|---|---|
| I. | 1V | in the tenor trombone corresponds to the 6th slide position |
| II. | 2-V | in the tenor trombone corresponds to the 7th slide position |

Tenor trombones with a quart valve exhibit advantages as regards the playing technique, since the same can be played with alternative slide positions. Hence, for the c, the slide is not required any more to be slid outward up to the sixth slide position, but instead, said tone can also be played with the valve in the first slide position. In a slide table, the notation therefore is IV (for the 1st slide position with valve) instead of 6 (for the 6th slide position). It is particularly advantageous that for specific tone jumps, a larger distance is not required to be covered by the slide, but instead, using the quart valve everything lying between slide position I. and V. can be played. As a result, smooth and fast playing is possible. The activation of the quart valve will be rendered obvious once again using the following slide table:

| tones | slide position |
|---|---|
| d` | I. |
| D-flat/C-sharp` | II. |
| c` | III. |
| h | IV. |
| b | I. |
| a | II. |
| A-flat/G-sharp | III. |
| g | IV. |
| F-sharp | V. |
| f | I. |
| e | II. |
| E-flat/D-sharp | III. |
| d | IV. |
| D-flat/C-sharp | V. |
| c | valve + I. corresponds to slide position VI. |
| H | valve + II. corresponds to slide position VII. |

The B/F tenor trombone which has a total length of approx. 1150 mm is difficult to handle for children. Children have difficulty in this regard, since they are not able yet to reach the outer slide positions due to their smaller body size and in particular shorter arm length. Due to the mere slideway alone, children aged between 10 and 14 regularly are not able to play beyond register V. In fact, in the first years of instrument training, playing is focused mainly on the d' (5th natural tone) and B (2nd natural tone) and use of slide positions VI. and VII. is omitted.

Furthermore, "instrument balance" is an issue as a result of the overall size. Due to the length of the slide, the instrument is pulled downward at the hand slide end, which has to be compensated for using muscle power. Poor balancing of the instrument is tiring for the trombonist, since weight has to be constantly counterbalanced manually.

It is well known that a secundo trombone is better to handle due to its smaller dimensions. The secundo trombone is a C trombone which is pitched higher by one whole tone. In this trombone, in particular the hand slide is shortened. The secundo trombone is upgraded again to B via the continuously activated valve by one "whole tone". As a result, slide positions are analogous to that of the B/F tenor trombone. Upon activation of the valve, upgrade is disabled, and the instrument is returned to original C tuning. At slide position 1, the c is thus played, and in slide position 2, the H is played.

Due to the C tuning, the secundo trombone exhibits a different sound character compared to the B/F tenor trombone. Tones c and H are played differently compared to the B/F tenor trombone. From a point of view of the playing technique, the difference resides in that in the B/F tenor trombone, the natural tone F is blown and the instrument is extended to tone c or H using the slide, whereas in the secundo trombone, the natural tone is played by deactivation of the valve (which corresponds to shortening of the instrument). In this context, in the case of a later changeover to a B/F tenor trombone, the playing technique has to be altered. Moreover, chromatic playing in the low-pitch range is only possible up to F-sharp/G-flat.

SUMMARY

B/F tenor trombone for children, comprising a sound part and a slide, composed of an inner slide and an outer slide being movably disposed thereon, wherein the total length formed by sound part and slide has a tubing length $L_{s1}+L_{s2}+L_{s3}+L_{z1}+L_{z2}+L_{z3}$, and wherein in the 1st register, the slide has a tubing length $L_{z1}+L_{z2}+L_{z3}$ of less than 150 cm, and wherein the sound part has a tubing length $L_{s1}+L_{s2}+L_{s3}$ of more than 125 cm.

BRIEF DESCRIPTION OF THE DRAWINGS

FIG. 1 illustrates a B/F tenor trombone for children.

DETAILED DESCRIPTION

The following detailed description refers to the accompanying drawings. Wherever possible, the same reference numbers are used in the drawings and the following description to refer to the same or similar elements. While embodiments may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the claimed subject matter. Instead, the proper scope of the claimed subject matter is defined by the appended claims.

The invention relates to a B/F tenor trombone for children according to the independent claim. The invention pertains to the field of brass wind instruments, in which sound is produced by means of excitation of natural resonance of the instrument in response to lip vibrations created by the trombonist.

It is an object of the invention to provide a tenor trombone which makes it possible to overcome the drawbacks of prior art, and to provide a trombone, in particular for children, which is easy to handle, and which does not require change of the playing technique when changing over to the B/F tenor trombone.

This object is attained by a B/F tenor trombone for children according to the independent claim. Advantageous aspects constitute the subject-matter of the subclaims.

The invention discloses a B/F tenor trombone for children, comprising a sound part (bell) and a slide, composed of an inner slide and an outer slide being movably disposed on the inner slide. The total length formed by sound part and slide has a tubing length $L_{s1}+L_{s2}+L_{s3}+L_{z1}+L_{z2}+L_{z3}$ (for tuning in the 2nd natural tone B). Section $L_{s2}$ as described in the following comprises a circumferential tube bend. In the 1st register, the slide has a tubing length $L_{z1}+L_{z2}+L_{z3}$ of less than 150 cm (in particular in the range of 130 cm to 140 cm, particularly preferably 1328 mm). The sound part has a length $L_{s1}+L_{s2}+L_{s3}$ of more than 125 cm (in particular of 130 to 140 cm, particularly preferably 1380 mm). Thanks to the tubing length of the slide, the B/F tenor trombone is easy to handle. As a result of the B tuning and the extended tube part it is not necessary to change the playing technique when switching over to a conventional B/F tenor trombone. This B/F tenor trombone, compared to the standard B/F tenor trombone (slide length 1585 mm), has a shortened slide (slide length 1328 mm) and a F quart valve with full functional capability. The total tubing length corresponds to the standard B/F tenor trombone, wherein the sound part is accordingly constructed with a longer shape due to the shortened length of the slide.

Particularly preferably, the slide has a length $L_{z1}+L_{z2}+L_{z3}$ in the 1st register of less than 135 cm. The sound part has a length $L_{s1}+L_{s2}+L_{s3}$ of more than 145 cm. The length $L_{z1}+L_{z2}+L_{z3}$ of the slide of known B/F tenor trombones is 1585 cm, so that the required tubing length represents an effective shortening of the instrument (approx. 15 cm) and enables accordingly enhanced handling. Due to the extended sound part, balance of the instrument is improved.

Particularly preferably, the sound part (in the tube run) has a completely circumferential tube bend. Said circumferential bend extends the tubing length of the sound part while maintaining the outer dimensions of the sound part. In the simplest case, the completely circumferential tube bend encloses an angle of 360°.

According to a preferred aspect, the completely circumferential tube bend includes two straight, parallel (to one another) extending sections and two tube bends (which are each interconnected at an end section to one of the straight sections). Hence, after one full turn, the length can be selected in accordance with the shortening of the slide.

According to another advantageous aspect, the sound part comprises a quart valve. The quart valve can be adjusted between a first position and a second position using a valve lever. The quart valve is connected to the completely circumferential tube bend in the first position, and is additionally connected to a valve slide in the second position. The tonal effect created by the quart valve corresponds to that of a standard B/F trombone.

According to a preferred example, the valve slide has a length of 95 cm. Said length of the valve slide produces the same tonal effect as that of the quart valve just like with a standard B/F trombone.

According to another particularly preferred aspect of the invention, the instrument length (outer edge—tube bend—sound part to outer edge—tube bend—slide part) is in the range of 98 to 103 cm. The standard B/F trombone is approx. 15 cm longer, resulting in advantages concerning handling and balance, which lead to overall enhanced playability for children. Moreover, the pitch range is broader than that of the secundo trombone. Additional tones F/E/E-flat/D/C-sharp can be played in the low-pitch range.

Hereinafter, the invention will be described in more detail with respect to the example illustrated in the attached drawing. FIG. 1 illustrates a B/F tenor trombone for children.

The illustrated B/F tenor trombone has a sound part 2 of a first sound part tube section $L_{s1}$, a second sound part tube section $L_{s2}$ (comprising an extension section) and a third sound part tube section $L_{s3}$. The illustrated B/F tenor trombone 1 has a slide 3 composed of an inner slide and an outer slide being movably disposed thereon, wherein in this illustration, only the outer slide can be seen, which is fully extended in accordance with the 1st register. The slide 3 comprises a first slide tube section $L_{z1}$, a second slide tube section $L_{z2}$ and a third slide tube section $L_{z3}$. The entire tubing length, encompassing sound part 2 (comprising an extension section) and slide 3, results in a tubing length $L_{s1}+L_{s2}+L_{s3}+L_{z1}+L_{z2}+L_{z3}$ for tuning in the 2nd natural tone B, which means a length which is selected such that tuning is produced in accordance with a standard B/F tenor trombone.

In the illustrated example, $L_{s1}$ is (612 mm), $L_{s2}$ is (579 mm), $L_{s3}$ is (189 mm), $L_{z1}$ is (580 mm), $L_{z2}$ is (576 mm) and $L_{z3}$ is (172 mm). The length of the tube bends $L_{s3}$ (189 mm) and $L_{z3}$ (172 mm) results from the distance of the imaginary end faces which adjoin the straight tube sections.

The sound part 2 comprises a completely (360°) circumferential tube bend 5 which has two straight (substantially) parallel sections 52 and two adjoining semicircular tube bends 51. The length of the completely circumferential tube bend 5 is formed by the length of the parallel sections 52 (approx. 5-10 cm) and the length of the two semicircular tube bends 51 (approx. 5-10 cm).

The sound part 2 has a quart valve 6 which can be adjusted between a first position and a second position with the aid of a valve lever 61. The quart valve 1 is connected to the completely circumferential tube bend 5 in the first position. After changeover to the second position, it is additionally connected to a valve slide 4. The illustrated valve slide has a length of approx. 95 mm.

The advantages of the invention in particular result from the (total) instrument length (outer edge—tube bend—sound part to outer edge—tube bend—slide part) of 101 cm.

Hereinafter, the invention will be described using a comparison with the instrument dimensions of prior art:

| B/F children trombone | B/F tenor trombone |
|---|---|
| $L_{s1}$ = 612 | $L_{s1}$ = 618 |
| $L_{s2}$ = 579 (incl. circumferential tube bend) | $L_{s2}$ = 305 |
| $L_{s3}$ = 189 1380 mm | $L_{s3}$ = 200 1123 mm |
| $L_{z1}$ = 580 | $L_{z1}$ = 722 |
| $L_{z2}$ = 576 | $L_{z2}$ = 717 |
| $L_{z3}$ = 172 1328 mm | $L_{z3}$ = 146 1585 mm |
| total tubing length 2708 mm | total tubing length 2708 mm |

What is claimed is:

1. B/F tenor trombone configured for children having shorter arms than adults, comprising a sound part and a slide with a length shorter than a length of a slide of a conventional trombone, the slide composed of an inner slide and an outer slide being movably disposed thereon, the sound part including a completely circumferential tube bend, wherein the total length formed by sound part and slide has a tubing length $L_{s1}+L_{s2}+L_{s3}+L_{z1}+L_{z2}+L_{z3}$, wherein $L_{z1}$, $L_{z2}$, $L_{z1}$, $L_{z2}$ correspond to lengths of straight parallel sections and $L_{s3}$, $L_{z3}$ correspond to semi-circular tube bends, and wherein in the 1st register, the slide has a tubing length $L_{z1}+L_{z2}+L_{z3}$ of less than 150 cm, and wherein the sound part has a tubing length $L_{s1}+L_{s2}+L_{s3}$ of more than 125 cm, wherein the total length formed by sound part and slide is the same as that of a conventional trombone.

2. B/F tenor trombone according to claim 1, wherein in the 1st register, the slide has a length $L_{z1}+L_{z2}+L_{z3}$ of 135 cm, and wherein the sound part has a length $L_{s1}+L_{s2}+L_{s3}$ of 145 cm.

3. B/F tenor trombone according to claim 2, wherein the completely circumferential tube bend of the sound part has two straight parallel sections and two semi-circular tube bends.

4. B/F tenor trombone according to claim 2, wherein the sound part comprises a quart valve, the quart valve being adjustable with the aid of a valve lever between a first position and a second position, and wherein in the first position, the quart valve is connected to the completely circumferential tube bend of the sound part, and in the second position, it is additionally connected to a valve slide.

5. B/F tenor trombone according to claim 4, wherein the valve slide has a length of 95 cm.

6. B/F tenor trombone according to claim 4, wherein the valve slide is a quart valve loop.

7. B/F tenor trombone according to claim 6, wherein the instrument length is in a range of 98 cm to 103 cm.

* * * * *